US008552322B2

(12) United States Patent
Takai

(10) Patent No.: US 8,552,322 B2
(45) Date of Patent: Oct. 8, 2013

(54) SWITCH DEVICE

(75) Inventor: Toshihito Takai, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 141 days.

(21) Appl. No.: 13/301,907

(22) Filed: Nov. 22, 2011

(65) Prior Publication Data

US 2012/0160655 A1 Jun. 28, 2012

(30) Foreign Application Priority Data

Dec. 28, 2010 (JP) ..... 2010-292713

(51) Int. Cl.
*H01H 1/10* (2006.01)

(52) U.S. Cl.
USPC ..... 200/515; 200/306

(58) Field of Classification Search
USPC ..... 200/306, 515, 302.2, 512, 513
See application file for complete search history.

(56) References Cited

U.S. PATENT DOCUMENTS 4,931,601 A * 6/1990 Lavender ..... 200/306
2011/0247926 A1* 10/2011 Osborn et al. ..... 200/515
2012/0138443 A1* 6/2012 Wang et al. ..... 200/515

FOREIGN PATENT DOCUMENTS

JP 2010-040490 2/2010

* cited by examiner

*Primary Examiner* — Felix O Figueroa
(74) *Attorney, Agent, or Firm* — Morgan, Lewis & Bockius LLP

(57) ABSTRACT

A switch device includes a base board having a face on which a fixed contact is provided and an elastic sheet that covers the face of the base board. The elastic sheet includes a contact dome part that covers the fixed contact to form a contact chamber, a movable contact that is provided on the contact dome part, a first recessed part that forms an air accumulating chamber, a second recessed part that forms a foreign material accumulating chamber, a guide groove that has a straight part and a circular arc part to form a guide passage for communicating the air accumulating chamber with the foreign material accumulating chamber, a nonreturn part provided inside the circular arc part, and a vent groove connected to the contact dome part and the guide groove to form a vent passage for communicating the contact chamber with the guide passage.

6 Claims, 5 Drawing Sheets

SWITCH DEVICE

BACKGROUND

The present invention relates to a switch device having a rubber sheet which is elastically deformed by receiving an operating force.

Usually, as a switch device used in a vehicle, for instance, a switch device is known that includes a base board having a fixed contact on one surface and a rubber sheet formed with an elastic material to cover the surface of the fixed contact side of the base board. The rubber sheet has a contact dome part that covers the fixed contact on the base board. A movable contact is provided in the base board side of the contact dome part. In this case, the contact dome part of the rubber sheet forms a contact chamber as a hollow space between the base board and the contact dome part. The contact chamber is allowed to communicate with an air accumulating chamber whose volume is larger than that of the contact chamber.

In the switch device having such a structure, when an operating force is applied to the contact dome part of the rubber sheet, the contact dome part is elastically deformed. Thus, the movable contact provided in the contact dome part comes into contact with the fixed contact provided on the base board. At this time, air in the contact chamber is compressed by the contact dome part of the rubber sheet to be pushed out to the air accumulating chamber. Then, when the operating force is released, the contact dome part in the rubber sheet is restored so that the movable contact of the contact dome part is disengaged from the fixed contact on the base board. Thus, the air pushed out to the air accumulating chamber is sucked to the contact chamber. As described above, during an operation of the switch device, the air in the contact chamber enters the air accumulating chamber and the air exits from the air accumulating chamber, what is called, the switch device breathes. Thus, a reaction of the air due to the compression of the air during the operation is prevented to make the operation easy.

However, in the above-described structure, the air accumulating chamber needs to ensure the volume larger than that of the contact chamber. Accordingly, the air accumulating chamber is frequently provided over a part on which, for instance a terminal of a connector or electronic parts are mounted on the base board. In this case, there is a fear that the contact chamber may possibly suck foreign materials such as solder chips remaining in the air accumulating chamber by breathing. Thus, the foreign materials are occasionally sandwiched between the fixed contact and the movable contact to cause an imperfect contact of these contacts.

Under the above-described circumstance, a structure is disclosed that a foreign material accumulating chamber is provided between a contact chamber and an air accumulating chamber (for instance, patent literature 1). In such a structure, the contact chamber does not directly communicate with the air accumulating chamber. Accordingly, when the contact chamber breathes by an operation, foreign materials present in the air accumulating chamber are temporarily sucked to the foreign material accumulating chamber. Thus, the foreign materials present in the air accumulating chamber are prevented from directly entering the contact chamber.

[Patent Literature 1] JP-A-2010-40490

However, the foreign material accumulating chamber directly communicates with the contact chamber. Accordingly, there is a fear that the contact chamber may possibly suck the foreign materials temporarily collected to the foreign material accumulating chamber.

SUMMARY

Thus, the present invention is devised by considering the above-described circumstances, and it is an object of the present invention to provide a switch device having a structure that foreign materials in an air accumulating chamber are hardly sucked to a contact chamber to reduce an imperfect contact due to the foreign materials.

In order to achieve the above-described object, a switch device of the present invention, comprising:

a base board having a face on which a fixed contact is provided; and an elastic sheet that covers the face of the base board, wherein the elastic sheet includes:

- a contact dome part that covers the fixed contact to form a hollow contact chamber between the base board and contact dome part and is elastically deformed by receiving an operating force;
- a movable contact that is provided on the contact dome part so as to face the fixed contact and contacts with the fixed contact when the contact dome part is elastically deformed;
- a first recessed part that forms a hollow air accumulating chamber between the base board and the first recessed part;
- a second recessed part that forms a hollow foreign material accumulating chamber between the base board and the second recessed part;
- a guide groove that has a straight part connected to the first recessed part and a circular arc part connected to the second recessed part at a position deviating from an extending line of the straight part to form a guide passage between the base board and the guide groove for communicating the air accumulating chamber with the foreign material accumulating chamber;
- a nonreturn part provided inside the circular arc part in a connecting part of the second recessed part and the circular arc part of the guide groove; and
- a vent groove connected to the contact dome part and the guide groove to form a vent passage between the base board and the vent groove for communicating the contact chamber with the guide passage.

Preferably, the vent groove is connected to the guide groove at a position nearer to the second recessed part than to the first recessed part.

Preferably, an angle formed by the guide groove and the vent groove at the connecting part is set to an acute angle.

Preferably, the nonreturn part is a straight inner wall of the foreign material accumulating chamber which defines a width of an inlet port of the foreign material accumulating chamber, and the straight inner wall of the foreign material accumulating chamber extends in substantially parallel with an extending direction of the straight part.

Here, it is preferable that, the foreign material accumulating chamber is formed by a semicircular inner wall and the straight inner wall.

Preferably, the nonreturn part is a straight inner wall of the foreign material accumulating chamber which extends in substantially parallel with an extending direction of the straight part, and the foreign material accumulating chamber is formed by a first semicircular inner wall, a second semicircular inner wall provided in substantially parallel with the first semicircular inner wall, and the straight inner wall connecting the first semicircular inner wall and the second semicircular inner wall.

According to the above-described structure, when the operating force is released and the elastically deformed contact dome part is restored to an original form, air in the air accumulating chamber is sucked to the contact chamber through the vent passage from the guide passage. At this time, foreign materials in the air accumulating chamber are occasionally sucked to the guide passage together with the air in the air accumulating chamber. Here, the guide passage is formed in the shape of a circular arc from the shape of a straight line and connected to the foreign material accumulating chamber. Therefore, the foreign materials sucked to the guide passage are easily guided to the foreign material accumulating chamber along the straight part of the guide passage. Accordingly, the foreign materials sucked to the guide passage hardly enter the contact chamber through the vent passage connected to the guide passage. Then, the foreign materials entering the foreign material accumulating chamber are prevented from flowing out from the foreign material accumulating chamber by the nonreturn part. In such a way, the switch device has a structure that the foreign materials in the air accumulating chamber are hardly sucked to the contact chamber. As a result, an imperfect contact due to the foreign materials is reduced.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

Figure 1:
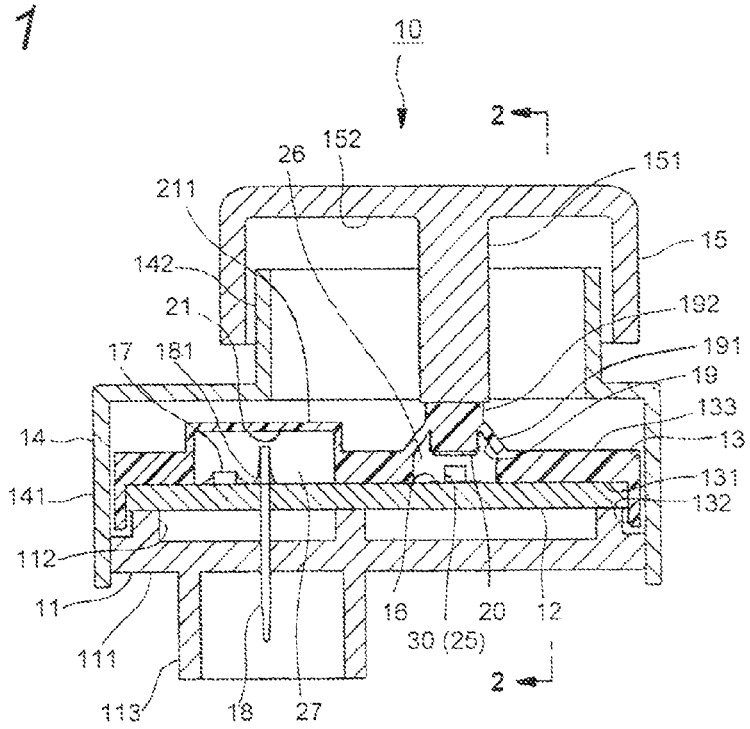
FIG. 1 is a longitudinally sectional front view of a switch device according to a first exemplary embodiment.

Now, switch devices according to a plurality of exemplary embodiments will be described below by referring to the drawings. In each of the exemplary embodiments, the same components are designated by the same reference numerals and an explanation thereof will be omitted.

(First Exemplary Embodiment)

FIG. 1 shows a switch device 10 which is provided in, for instance, a vehicle to operate a turning on or off state of a defogger. An upper side of FIG. 1 will be described as an upper part of the switch device 10 and a lower side of FIG. 1 will be described as a lower part of the switch device 10, hereinafter.

Figure 2:
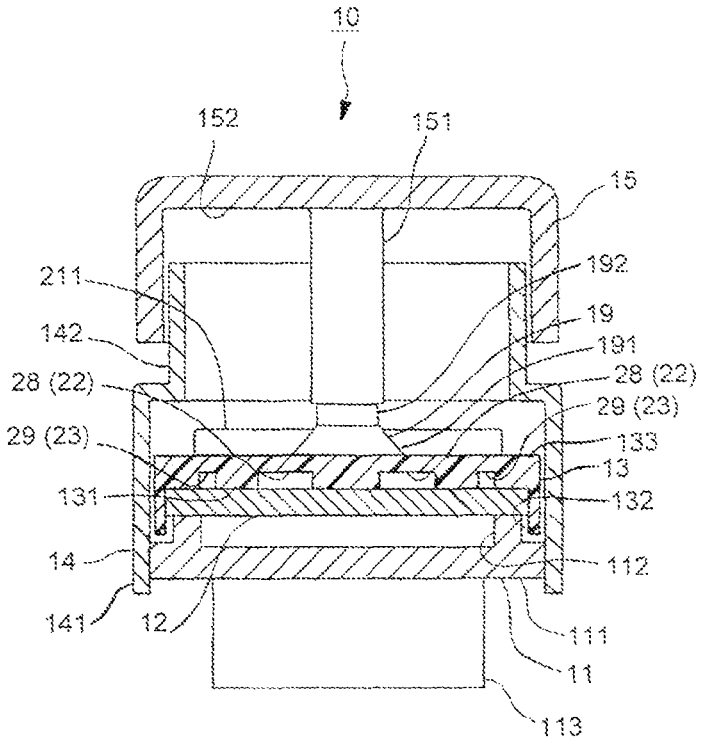
FIG. 2 is a longitudinally sectional side view taken along a line A-A in FIG. 1.
Figure 5:
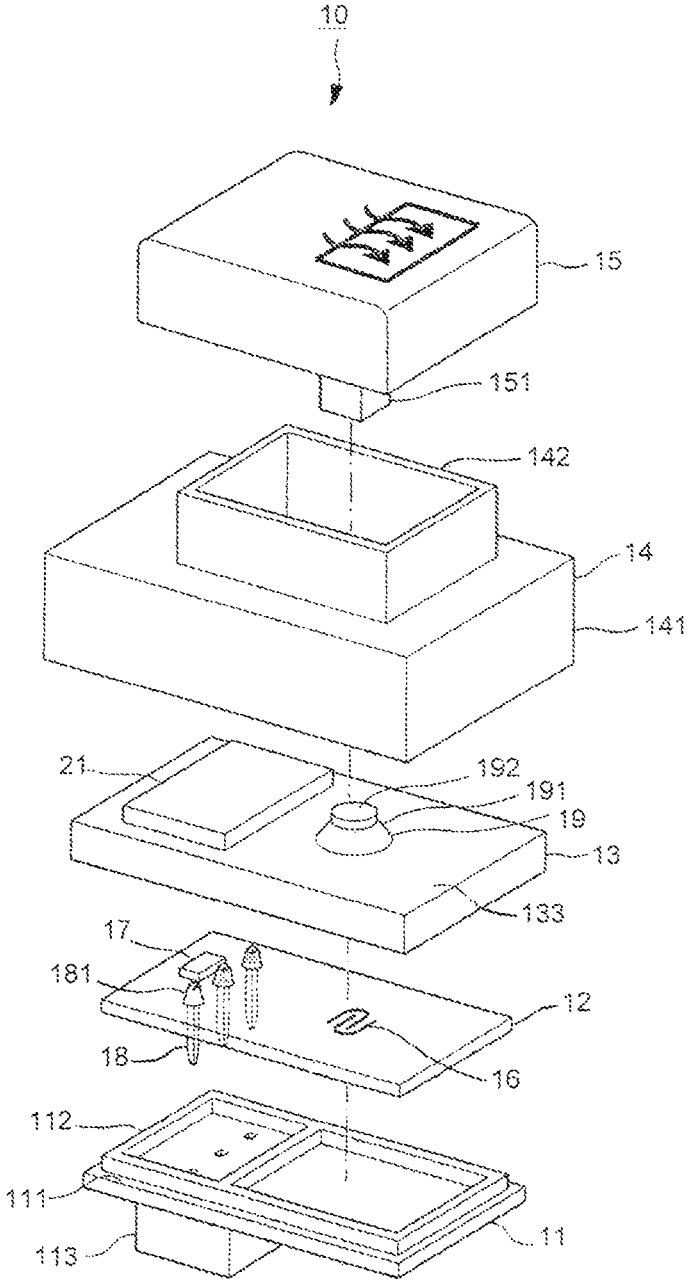
FIG. 5 is an exploded perspective view of the switch device.

As shown in FIG. 1, FIG. 2 and FIG. 5, the switch device 10 includes a base 11, a base board 12, a rubber sheet 13, a case 14 and an operating member 15. The base 11 includes a main body part 111, a support part 112 and a connector part 113. The main body part 111 is formed in the shape of a rectangular plate. The support part 112 is provided in one surface of the main body part 111, namely, an upper side surface and formed in the shape of a rectangular box opened upward. The connector part 113 is provided in the other surface of the main body part 111, namely, a lower side surface opposite to the support part 112 and formed in the shape of a rectangular box opened downward. The main body part 111, the support part 112 and the connector part 113 are integrally formed with a resin.

The base board 12 is provided in an upper side of the support part 112 of the base 11. The base board 12 is formed in the shape of a rectangular plate by, for instance, a printed wiring board. On one surface of the base board 12, specifically, on an opposite surface to the base 11, that is, on an upper side surface, a fixed contact 16 and an electronic parts 17 are provided. As shown in FIG. 5, the fixed contact 16 is formed with one pair of electrically disconnected contacts. The fixed contact 16 is formed with, for instance, metal excellent in its electrical conductivity and exposed on an upper surface of the base board 12 under a non-insulated state. The electronic parts 17 is, for instance, a resistance element and fixed to the base board 12 by soldering as shown in FIG. 1.

The base board 12 has a terminal 18 in the vicinity of the electronic parts 17. The terminal 18 is formed with a metal rod having an electrical conductivity. The terminal 18 passes through the base board 12 in the direction of thickness and has one end part protruding on the surface of the base board 12 of the fixed contact 16 side. The terminal 18 has one end part soldered and fixed to the base board 12. In this case, in the periphery of the terminal 18, a solder part 181 is formed. Further, the fixed contact 16, the electronic parts 17 and the terminal 18 are electrically connected by a wiring pattern not shown in the drawing to form a circuit not shown in the drawing.

Further, the terminal 18 passes through the main body part 111 of the base 11 and has the other end part protruding to the connector part 113. In this case, the connector part 113 and the terminal 18 form a male type connector. To the connector part 113, what is called a female type connector, whose detail is not shown, is fitted. Thus, the switch device 10 is connected to a controller not shown in the drawing that controls the defogger. Then, a signal that supplies an electric current or does not supply an electric current to the fixed contact 16 is transmitted to the controller from the switch device 10.

Figure 3:
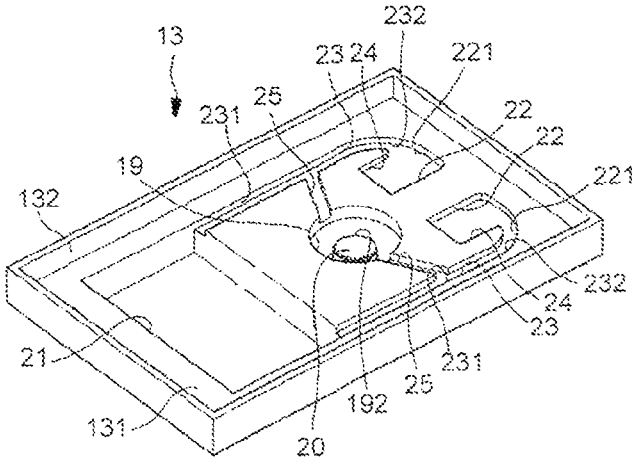
FIG. 3 is a perspective view of a rubber sheet seen from a back side.

The rubber sheet 13 is provided on the upper surface of the base board 12, namely, on the surface of the base board 12 of the base board 12 of the fixed contact 16 side. The rubber sheet 13 is formed with a material having elasticity, for instance, silicone rubber. As shown in FIG. 3, the rubber sheet 13 has a peripheral wall 132 in the periphery of a flat attaching surface 131. In this case, as shown in FIG. 1, the peripheral wall 132 has a dimension in the vertical direction set to be larger than a dimension in the direction of thickness of the base board 12. Thus, in the rubber sheet 13, the attaching surface 131 is arranged on the upper surface of the base board 12 to cover an en entire part of the surface of the base board 12 of the fixed contact 16 side.

Figure 4:
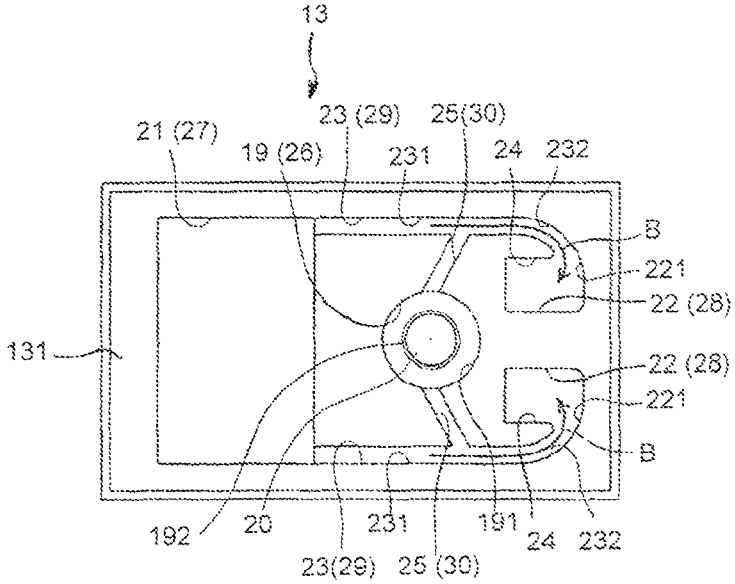
FIG. 4 is a bottom view of the rubber sheet.

As shown in FIG. 3 and FIG. 4, the rubber sheet 13 includes one contact dome part 19, one movable contact 20, a first recessed part 21, two second recessed parts 22, two guide grooves 23, two nonreturn parts 24 and two vent grooves 25. As shown in FIG. 1, the contact dome part 19 is arranged correspondingly to the fixed contact 16 provided on the base board 12. The contact dome part 19 includes a deformed part 191 and a pressed part 192. The deformed part 191 of the contact dome part 19 is recessed in the shape of a bowl or in the shape of a hemisphere upward from the attaching surface 131 of the rubber sheet 13, namely, in an opposite direction to the base board 12. The deformed part 191 protrudes upward from a surface 133 of the rubber sheet 13, namely, protrudes to the opposite direction to the base board 12. In this case, the deformed part 191 has a thickness formed to be smaller than the thickness of the attaching surface 131. Then, the contact dome part 19 forms a hollow contact chamber 26 between the base board 12 and the contact dome part 19 to cover the fixed contact 16.

The pressed part 192 of the contact dome part 19 is provided in a central part of the deformed part 191. The pressed part 192 is formed in a cylindrical shape and passes through the deformed part 191 substantially vertically to the attaching surface 131 of the rubber sheet 13. In this case, the pressed part 192 has one end part protruding to the base board 12 side of the deformed part 191 and the other end part protruding to an opposite side of the deformed part 191 to the base board 12.

The movable contact 20 is provided in one end part of the pressed part 192. The movable contact 20 is formed with a material having an electrical conductivity, for instance, a metal film or an electrically conductive resin. When an operating force is applied to the pressed part 192 to elastically deform the deformed part 191, the movable contact 20 is engaged with or disengaged from the fixed contact 16 on the base board 12. Thus, a state of the fixed contact 16 is switched that an electric current is supplied or an electric current is not supplied.

As shown in FIG. 1, the first recessed part 21 is arranged correspondingly to the electronic parts 17 and the terminal 18 provided on the base board 12. As shown in FIG. 1 and FIG. 2, the first recessed part 21 is recessed, in the shape of a rectangular box, upward from the attaching surface 131 of the rubber sheet 13, namely, in an opposite direction to the base board 12. Then, the first recessed part 21 protrudes upward from the surface 133 of the rubber sheet 13, namely, protrudes to the opposite direction to the base board 12. In this case, in the first recessed part 21, an upper wall 211 protruding upward from the surface 133 is elastically deformed. Then, as shown in FIG. 1, the first recessed part 21 forms an air accumulating chamber 27 between the base board 12 and the first recessed part 21 to cover the electronic parts 17 and the terminal 18 on the base board 12. In the case of this exemplary embodiment, a dimension of the first recessed part 21 is set so that the volume of the air accumulating chamber 27 is sufficiently larger than the volume of the contact chamber 26. Further, when the upper wall 211 of the first recessed part 21 is elastically deformed, a content volume of the air accumulating chamber 27 is slightly changed.

Further, as shown in FIG. 4, the two second recessed parts 22, the two guide grooves 23, the two nonreturn parts 24 and the two vent grooves 25 provided in the rubber sheet 13 are respectively linear-symmetrically arranged with respect to a central axis passing through a center of the contact dome part 19 and the rubber sheet 13 in the longitudinal direction. Specifically, the two second recessed parts 22 are provided in an opposite side to the first recessed part 21 with respect to the contact dome part 19 in the longitudinal direction of the rubber sheet 13. Namely, the contact dome part 19 is arranged between the first recessed part 21 and the second recessed parts 22 in the longitudinal direction of the rubber sheet 13. Further, each of the second recessed parts 22 is provided in each of both outer sides of the contact dome part 19 in a transverse direction of the rubber sheet 13. The second recessed part 22 is generally formed in a rectangular shape and has a guide wall 221 in one side. In the guide wall 221, a part of a peripheral wall forming the second recessed part 22 which is distant from the contact dome part 19 is formed to expand outside in the shape of a circular arc.

As shown in FIG. 2 and FIG. 4, the second recessed parts 22 are recessed upward from the attaching surface 131 of the rubber sheet 13, namely, in the opposite direction to the base board 12. In this case, the depth of the second recessed parts 22 is set to be smaller than that of the first recessed part 21. In the present exemplary embodiment, the second recessed parts 22 do not protrude upward from the surface 133 of the rubber sheet 13. Then, the second recessed parts 22 form hollow foreign material accumulating chambers 28 between the base board 12 and the second recessed parts 22. In this case, the peripheral walls of the second recessed parts 22 are hardly elastically deformed. Accordingly, in the foreign material accumulating chambers 28, content volumes are hardly changed. Further, in the present exemplary embodiment, dimensions of the second recessed parts 22 are set so that the volumes of the foreign material accumulating chambers 28 are sufficiently smaller than the volumes of the contact chamber 26 and the air accumulating chamber 27.

As shown in FIG. 4, the guide grooves 23 are respectively provided at both outer sides in the transverse direction of the rubber sheet 13 with respect to the contact dome part 19. In the case of the present exemplary embodiment, as shown in FIG. 2 and FIG. 3, the depth of the guide grooves 23 is set substantially to the same depth as that of the second recessed parts 22. Further, the width and the depth of the guide grooves 23 are set substantially to the same dimension. The guide grooves 23 are arranged between the first recessed part 21 and the second recessed parts 22 to connect the first recessed part 21 to the second recessed parts 22.

Specifically, as shown in FIG. 4, the guide groove 23 has a straight part 231 and a circular arc part 232. The straight part 231 of the guide groove 23 is connected to the first recessed part 21. The circular arc part 232 of the guide groove 23 is connected to the second recessed part 22. In this case, in the circular arc part 232, a diametrically outer wall forming the circular arc part 232 is smoothly connected to the guide wall 221 of the second recessed part 22. In such a way, the circular arc part 232 of the guide groove 23 is connected to the second recessed part 22 at a position deviating from an extending line of the straight part 231. Further, the second recessed part 22 is provided inside in the transverse direction of the rubber sheet 13 relative to the straight part 231 of the guide groove 23, namely, provided in the contact dome part 19 side. Then, as shown in FIG. 2, the guide groove 23 of the rubber sheet 13 forms a guide passage 29 between the base board 12 and the guide groove 23. Through the guide passages 29, the air accumulating chamber 27 communicates with the foreign material accumulating chambers 28. In the case of the present exemplary embodiment, the diametrically outer wall forming the circular arc part 232 and the guide wall 221 of the second recessed part 22 are set so as to have substantially the same radius of curvature.

As shown in FIG. 4, the two nonreturn parts 24 are respectively provided inside the circular arc parts 232 in the connecting parts of the second recessed parts 22 and the circular arc parts 232 of the guide grooves 23. Namely, the second recessed parts 22 have rear parts connected to the circular arc parts 232 of the guide grooves 23. Then, the second recessed parts 22 are extended to the contact dome part 19 side substantially in parallel with the straight parts 231 of the guide grooves 23 from the connecting parts to the circular arc parts 232. The nonreturn parts 24 are formed by one parts of the peripheral walls forming the second recessed parts 22, that is, walls between the second recessed parts 22 and the guide grooves 23.

As shown in FIG. 4, each of the vent grooves 25 is provided in each of both the outer sides of the rubber sheet 13 in the transverse direction relative to the contact dome part 19. Each of the vent grooves 25 is formed substantially in a straight line. The vent groove 25 has one end part connected to a part in the vicinity of the center of the contact dome part 19 in the longitudinal direction of the rubber sheet 13 and the other end part connected obliquely to the straight part 231 of the guide groove 23. In this case, the other end part of the vent groove 25 is connected to the guide groove 23 at a part nearer to the second recessed part 22 than the first recessed part 21. Thus, the vent groove 25 of the rubber sheet 13 forms a vent passage 30 through which the contact chamber 26 communicates with the guide passage 29 between the base board 12 and the vent groove 25.

In the present exemplary embodiment, as shown in FIG. 3, the depth of the vent groove 25 is set so as to have substantially the same dimension as that of the depth of the guide groove 23. Then, the width of the vent groove 25 is set to be the same as or smaller than the width of the guide groove 23. Further, as shown in FIG. 4, an angle formed by the guide groove 23 and the vent groove 25 in a connecting part of the guide groove 23 and the vent groove 25 is set to be smaller in the first recessed part 21 side than in the second recessed part 22 side.

As shown in FIG. 1 and FIG. 2, the base 11, the base board 12 and the rubber sheet 13 of the switch device 10 are accommodated in the case 14. The case 14 includes a lower case part 141 and an upper case part 142. The lower case part 141 is formed in the shape of a rectangular box having a lower side opened. The lower case part 141 accommodates the base 11, the base board 12 and the rubber sheet 13 in order from a lower part. Further, as shown in FIG. 5, the upper case part 142 is formed in the shape of a rectangular tube having an upper side opened. The lower case part 141 has an upper part connected to a lower part of the upper case part 142. The lower case part 141 and the upper case part 142 are integrally formed with a resin. In this case, the case 14 has the upper and lower parts opened and communicating with each other.

In the case 14, the operating member 15 is provided in the upper case part 142. Specifically, as shown in FIG. 1, FIG. 2 and FIG. 5, the operating member 15 is formed in the shape of a rectangular box larger substantially by a size than the upper case part 142. Then, the operating member 15 is fitted to an outer side of the upper case part 142 of the case 14 so as to freely slide. Thus, the operating member 15 moves in the vertical direction relative to the upper case part 142 of the case 14. Further, the operating member 15 has a transmitting part 151. The transmitting part 151 is located in the vicinity of a center of a ceiling surface 152 of the operating member 15, formed in the shape of a rectangular post and protrudes vertically to the rubber sheet 13 side from the ceiling surface 152. The transmitting part 151 has a lower surface that comes into contact with an upper surface of the pressed part 192 of the contact dome part 19 provided in the rubber sheet 13. Accordingly, the operating force inputted to the operating member 15 is transmitted to the pressed part 192 through the transmitting part 151.

Now, an operation of the above-described structure will be described below.

In the switch device 10, when a user presses the operating member 15, the operating member 15 is moved downward. Then, the pressed part 192 of the contact dome part 19 formed in the rubber sheet 13 is pressed downward by the transmitting part 151 of the operating member 15. At this time, the deformed part 191 of the contact dome part 19 formed in the rubber sheet 13 is collapsed downward and elastically deformed. Then, when the deformed part 191 of the contact dome part 19 is collapsed and elastically deformed, the movable contact 20 provided in a lower surface of the pressed part 192 comes into contact with the fixed contact 16 on the base board 12. Thus, in the fixed contact 16, one pair of contacts which are electrically disconnected is electrically conducted to each other.

In this case, the switch device 10 is turned on and a turning on signal processed by the electronic parts 17 of the base board 12 is transmitted to a controller of the defogger not shown in the drawing through the terminal 18. As a result, the defogger is driven. After that, when the user releases a pressing operation of the operating member 15, the deformed part 191 of the contact dome part 19 which is elastically deformed is restored to the shape of the bowl before the deformation. In this case, the movable contact 20 provided in the lower surface of the pressed part 192 is disengaged from the fixed contact 16 on the base board 12 in accordance with the restoration of the deformed part 191 of the contact dome part 19. Then, in accordance with the restoration of the deformed part 191, the operation member 15 is pressed upward and returned to an initial position before the operation.

During the above-described operation, between spaces formed between the base board 12 and the rubber sheet 13, that is, the contact chamber 26, the air accumulating chamber 27, the foreign material accumulating chambers 28, the guide passages 29 and the vent passages 30, a flow of air is generated. Now, the flow of the air during the operation will be described by mainly referring to FIG. 4.

In the contact dome part 19 of the rubber sheet 13, when the pressed part 192 is pressed downward by the transmitting part 151 of the operating member 15, the deformed part 191 is collapsed and elastically deformed. Thus, the content volume of the contact chamber 26 is reduced in accordance with the elastic deformation of the deformed part 191 of the contact dome part 19. Therefore, the air in the contact chamber 26 is pushed out. The air pushed out from the contact chamber 26 is supplied to the guide passages 29 through the vent passages 30. In this case, while the guide passages 29 are connected to the air accumulating chamber 27 and the foreign material accumulating chambers 28, the air accumulating chamber 27 has a content volume sufficiently larger than that of the foreign material accumulating chamber 28. Accordingly, most of the air supplied to the guide passages 29 is supplied to the air accumulating chamber 27.

Then, when the pressing operation of the operating member 15 is released, the deformed part 191 in the contact dome part 19 of the rubber sheet 13 is restored to the shape of an original bowl by its elasticity. Then, the content volume of the contact chamber 26 is increased in accordance with the restoration of the deformed part 191 of the contact dome part 19. Therefore, the contact chamber 26 sucks therein the air in the periphery thereof, that is, the air in the air accumulating chamber 27, the foreign material accumulating chambers 28, the guide passages 29 and the vent passages 30. In this case, the deformed part 191 of the contact dome part 19 is restored during a short time. Accordingly, the air in the periphery of the contact chamber 26 is sucked to the contact chamber 26 during the short time when the deformed part 191 is restored.

At this time, the air in the air accumulating chamber 27 is sucked to the guide passages 29. When foreign materials such as dust or solder chips remain in the air accumulating chamber 27, the foreign materials are occasionally sucked to the guide passages 29 together with the air. In this case, the foreign materials sucked to the guide passages 29 advance linearly along the straight parts 231 in the guide passages 29. Then, the foreign materials pass connecting parts of the guide passages 29 and the vent passages 30, advance along the circular arc parts 232 due to an inertia as shown by arrow marks B and further enter the foreign material accumulating chambers 28 along the guide walls 221 of the second recessed parts 22 forming the foreign material accumulating chambers 28.

Here, in the case of the present exemplary embodiment, the diametrically outer walls of the circular arc parts 232 forming the guide passages 29 and the guide walls 221 of the second recessed parts 22 forming the foreign material accumulating chambers 28 are set so as to have substantially the same radius of curvature. Accordingly, the foreign materials are smoothly guided to the foreign material accumulating chambers 28 along the walls of the circular arc parts 232 and the guide walls 221. Further, in the guide passages 29 and the vent passages 30, angles formed by the guide passages 29 of the air accumulating chamber 27 side and the vent passages 30 are set to be smaller than angles formed by the guide passages 29 of the foreign material accumulating chamber 28 side and the vent passages 30. Therefore, the foreign materials sucked to the guide passages 29 hardly enter the vent passages 30.

Then, when the switch device 10 is further operated, the flow of the air is generated again between the contact chamber 26, the air accumulating chamber 27, the foreign material accumulating chambers 28, the guide passages 29 and the vent passages 30. In this case, the foreign material entering the foreign material accumulating chambers 28 are apt to enter the guide passages 29 by the flow of the air, however, a backflow of the foreign materials to the guide passages 29 is stopped by the nonreturn parts 24. Accordingly, after the foreign materials are once collected to the foreign material accumulating chambers 28, the foreign materials hardly flow backward from the foreign material accumulating chambers 28.

Further, in the case of the present exemplary embodiment, the content volumes of the foreign material accumulating chambers 28 are sufficiently smaller than the content volume of the air accumulating chamber 27. Further, since the walls forming the peripheries of the foreign material accumulating chambers 28 are hardly elastically deformed, the content volumes of the foreign material accumulating chambers 28 are hardly changed. Accordingly, the air pushed out from the contact chamber 26 hardly enters the foreign material accumulating chambers 28. Thus, the flow of air is hardly generated therein. As a result, the foreign materials entering the foreign material accumulating chambers 28 are hardly agitated by the flow of the air and the backflow of the foreign materials to the guide passages 29 can be more effectively prevented.

As described above, according to the present exemplary embodiment, when the operating member 15 is pressed, since the deformed part 191 of the contact dome part 19 is elastically deformed, the air in the contact chamber 26 is pushed out to the air accumulating chamber 27. Then, the operating force is released so that the deformed part 191 of the contact dome part 19 is restored, the contact chamber 26 sucks the air in the air accumulating chamber 27. In such a way, since the switch device 10 carries out what is called a breathing operation, a reaction of the air due to a compression of the air in the contact chamber 26 during the operation is prevented to make the operation easy.

In this case, the foreign materials sucked to the guide passages 29 from the air accumulating chamber 27 due to breathing hardly enter the vent passages 30 branching from the guide passages 29. Namely, the foreign materials sucked to the guide passages 29 pass the guide passages 29 and are guided to the foreign material accumulating chambers 28 due to the inertia. Then, the foreign materials entering the foreign accumulating chambers 28 are prevented from flowing out from the foreign material accumulating chambers 28 by the nonreturn parts 24. In such a way, the switch device 10 has a structure that the foreign materials remaining in the air accumulating chamber 27 are hardly sucked to the contact chamber 26. As a result, an imperfect contact is reduced that is caused by the foreign materials entering between the fixed contact 16 and the movable contact 20.

Further, according to the present exemplary embodiment, the vent passages 30 through which the contact chamber 26 communicates with the guide passages 29 are connected to the guide passages 29 at positions nearer to the foreign material accumulating chambers 28 than to the air accumulating chamber 27. Accordingly, the foreign materials entering the guide passages 29 from the air accumulating chamber 27 are guided to the foreign material accumulating chambers 28 without stopping in the vicinity of the connecting parts of the guide passages 29 and the vent passages 30. Therefore, the foreign materials entering the guide passages 29 from the air accumulating chamber 27 are more assuredly guided to the foreign material accumulating chambers 28. As a result, the imperfect contact due to the foreign materials is more effectively reduced.

Here, the contact chamber 26 sucks the air in the periphery thereof during the short time when the operating force to the operating member 15 is released so that the deformed part 191 of the contact dome part 19 is restored. Namely, a suction force that the contact chamber 26 sucks the air in the periphery is weakened during the short time after the operating force to the operating member 15 is released. Therefore, as a moving distance, that is, a moving time to the connecting parts of the guide passages 29 and the vent passages 30 is more increased, the foreign materials entering the guide passages 29 from the air accumulating chamber 27 are the more hardly sucked to the contact chamber 26 from the connecting parts. In the present exemplary embodiment, the vent passages 30 are connected to the guide passages 29 at the positions nearer to the foreign material accumulating chambers 28 than to the air accumulating chamber 27. Therefore, the distance can be ensured until the foreign materials pass the connecting parts of the guide passages 29 and the vent passages 30. As a result, the switch device 10 has the structure that the foreign materials are more hardly sucked to the contact chamber 26.

(Second Exemplary Embodiment)

Figure 6:
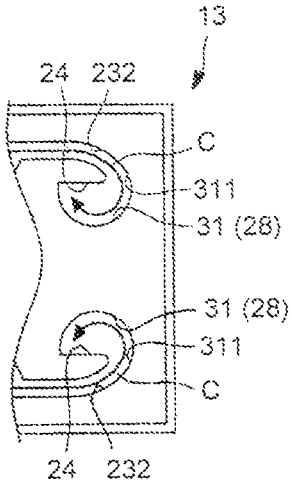
FIG. 6 is a diagram showing a periphery of a second recessed part of a rubber sheet according to a second exemplary embodiment.

As shown in FIG. 6, a second exemplary embodiment is different from the first exemplary embodiment in view of a point that second recessed parts 31 are generally formed in circular shapes, namely, semicircular shapes. In this case, guide walls 311 of the second recessed parts 31 are formed in the shapes of circular arcs and connected to nonreturn parts 24. According to this structure, as shown by arrow marks C, foreign materials entering foreign accumulating chambers 28 advance along the guide walls 311 and are stopped by the nonreturn parts 24. Accordingly, the backflow of the foreign materials can be more effectively prevented.

(Third Exemplary Embodiment)

Figure 7:
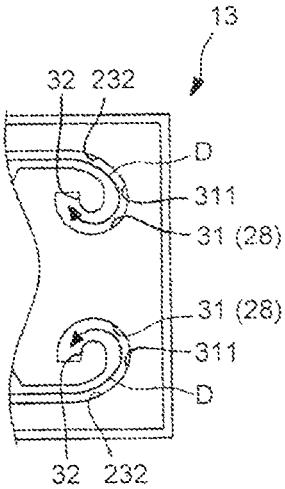
FIG. 7 is a diagram corresponding to FIG. 6 that shows a third exemplary embodiment.

As shown in FIG. 7, a third exemplary embodiment is different from the exemplary embodiments respectively in view of a point that second recessed parts 31 are generally formed in circular shapes, namely, semicircular shapes and nonreturn parts 32 are formed in the shapes of hooks bent inside the second recessed parts 31. According to this structure, foreign materials entering foreign material accumulating chambers 28 advance along guide walls 311, turn inside the nonreturn parts 32 and are stopped by the nonreturn parts 32 as shown by arrow marks D. Accordingly, the backflow of the foreign materials can be more effectively prevented.

In the above-described exemplary embodiments respectively, the rubber sheet 13 includes the two second recessed parts 22 or the two second recessed parts 31, the two guide grooves 23, the two nonreturn parts 24 or the two nonreturn parts 32 and the two vent grooves 25 relative to the one contact dome part 19. However, the present invention is not limited thereto, and the number of the second recessed parts 22 or the second recessed parts 31, the guide grooves 23, the nonreturn parts 24 or the nonreturn parts 32 and the vent grooves 25 relative to the contact dome part 19 may be suitably increased or decreased. Further, a plurality of first recessed parts 21 whose volumes are respectively smaller than the volume of the contact dome part 19 may be allowed to mutually communicate. Further, the rubber sheet 13 may include a plurality of contact dome parts 19. In this case, the plurality of contact dome parts 19 may be allowed to communicate with one first recessed part 21.

In the above-described exemplary embodiments, the switch device is shown that is used in the defogger of the vehicle, however, the present invention is not limited thereto, the switch device of the present invention may be widely applied to switch devices used for other units than the vehicle.

In addition, the present invention is not limited to the above-described exemplary embodiments shown in the drawings and may be suitably changed and embodied within a range that does not deviate from a gist of the invention.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japanese Patent Application No. 2010-292713 filed on Dec. 28, 2010, the contents of which are incorporated herein by reference.

What is claimed is:

1. A switch device, comprising:

a base board having a face on which a fixed contact is provided; and an elastic sheet that covers the face of the base board, wherein the elastic sheet includes:

a contact dome part that covers the fixed contact to form a hollow contact chamber between the base board and said contact dome part and is elastically deformed by receiving an operating force;

a movable contact that is provided on the contact dome part so as to face the fixed contact and contacts with the fixed contact when the contact dome part is elastically deformed;

a first recessed part that forms a hollow air accumulating chamber between the base board and the first recessed part;

a second recessed part that forms a hollow foreign material accumulating chamber between the base board and the second recessed part;

a guide groove that has a straight part connected to the first recessed part and a circular arc part connected to the second recessed part at a position deviating from an extending line of the straight part to form a guide passage between the base board and the guide groove for communicating the air accumulating chamber with the foreign material accumulating chamber;

a nonreturn part provided inside the circular arc part in a connecting part of the second recessed part and the circular arc part of the guide groove; and a vent groove connected to the contact dome part and the guide groove to form a vent passage between the base board and the vent groove for communicating the contact chamber with the guide passage.

2. The switch device according to claim 1, wherein the vent groove is connected to the guide groove at a position nearer to the second recessed part than to the first recessed part.

3. The switch device according to claim 1, wherein an angle formed by the guide groove and the vent groove at the connecting part is set to an acute angle.

4. The switch device according to claim 1, wherein the nonreturn part is a straight inner wall of the foreign material accumulating chamber which defines a width of an inlet port of the foreign material accumulating chamber; and wherein the straight inner wall of the foreign material accumulating chamber extends in substantially parallel with an extending direction of the straight part.

5. The switch device according to claim 4, wherein the foreign material accumulating chamber is formed by a semicircular inner wall and the straight inner wall.

6. The switch device according to claim 1, wherein the nonreturn part is a straight inner wall of the foreign material accumulating chamber which extends in substantially parallel with an extending direction of the straight part; and wherein the foreign material accumulating chamber is formed by a first semicircular inner wall, a second semicircular inner wall provided in substantially parallel with the first semicircular inner wall, and the straight inner wall connecting the first semicircular inner wall and the second semicircular inner wall.

* * * * *